United States Patent [19]

Uebel

[11] 4,104,001

[45] Aug. 1, 1978

[54] RECIPROCATING TAMPING TOOL

[75] Inventor: Philip Uebel, Unterschleissheim, Lohhof, Fed. Rep. of Germany

[73] Assignee: Robert Bosch GmbH, Stuttgart, Fed. Rep. of Germany

[21] Appl. No.: 857,767

[22] Filed: Dec. 5, 1977

[30] Foreign Application Priority Data

Jan. 22, 1977 [DE] Fed. Rep. of Germany ..... 2702577

[51] Int. Cl.[2] ..... E01C 19/30

[52] U.S. Cl. ..... 404/133

[58] Field of Search ..... 404/133, 113, 116

[56] References Cited

U.S. PATENT DOCUMENTS

| | | | |
|---|---|---|---|
| 3,090,286 | 5/1963 | Kestel | 404/133 |
| 3,286,790 | 11/1966 | Kestel | 404/133 X |
| 3,538,821 | 11/1970 | Baeumers | 404/133 |
| 3,630,127 | 12/1971 | Yamato | 404/133 |
| 3,847,498 | 11/1974 | Grane | 404/133 |
| 4,015,909 | 4/1977 | Yamamoto | 404/133 |

*Primary Examiner*—Nile C. Byers

*Attorney, Agent, or Firm*—Michael J. Striker

[57] ABSTRACT

A manually guided implement with a tool performing a reciprocating up-and-down motion and which is driven by a motor over a connecting rod and a swing system guided in a cylinder connected to the housing of the implement.

9 Claims, 1 Drawing Figure

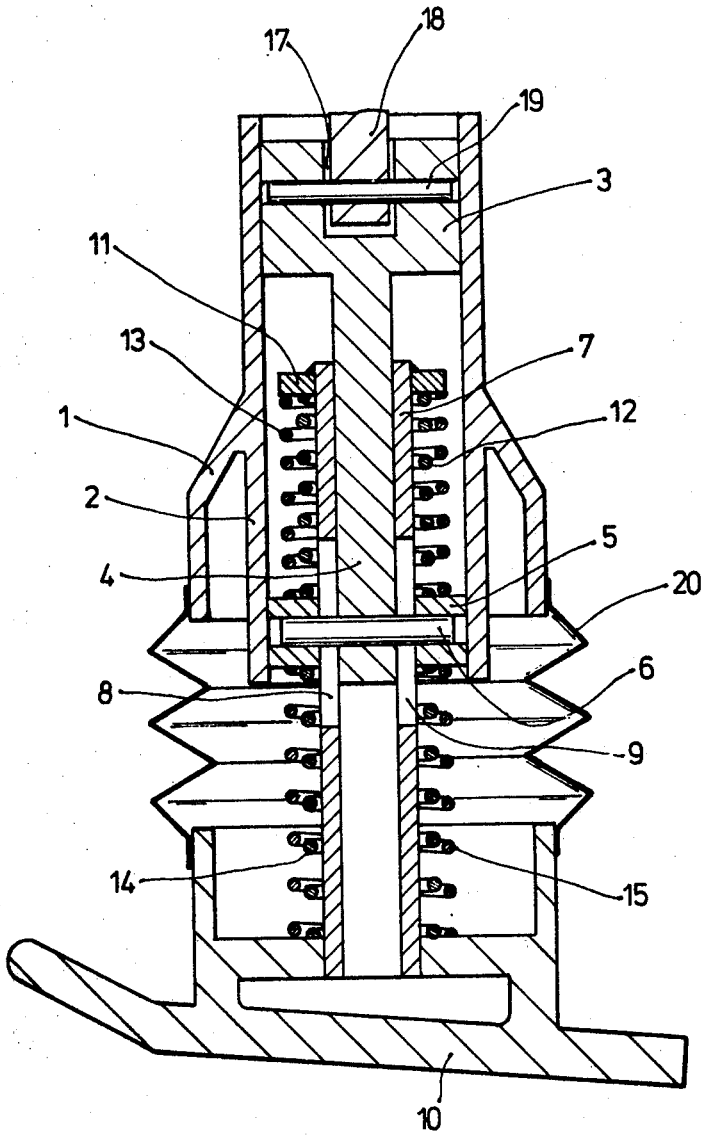
17
18
19
3
11
13
7
1
12
2
5
4
20
6
8
9
14
15
10

RECIPROCATING TAMPING TOOL

BACKGROUND OF THE INVENTION

The present invention relates to a manually guided implement having a tool performing a reciprocating up-and-down movement, in which the tool is driven by a motor over a connecting rod and a swing system guided in a cylinder connected to the housing of the implement.

In a known implement of the aforementioned kind, the tool is connected to the free end of a sleeve arranged for vertical reciprocation in a cylinder fixed to the housing of the impliment. A piston is axially guided in the sleeve and is linked to a connecting rod to be driven from a rotating motor over a gear unit and a crank. Springs abut with opposite ends respectively against opposite end faces of the piston and transverse members provided at opposite ends of the sleeve. During rotation of the motor, the piston is moved up-and down in the sleeve, whereby the sleeve is driven by the springs from the piston to carry out in the cylinder a sliding up-and-down movement. This movement of the sleeve is transmitted to a tool fixedly connected to an end of the sleeve, projecting beyond the cylinder.

In order to assure in the mentioned construction an exact movement of the piston, which is driven by the connecting rod, the cylindrical peripheral face of the piston must have a necessary minimum length to avoid canting of the piston and, furthermore, the guide sleeve for the piston must also have a sufficient length so that the guide sleeve even at a maximum stroke is still perfectly guided in axial direction.

The thus resulting large contact faces between the guide sleeve and the cylinder, on the one hand, and the guide sleeve and the piston, on the other hand, form relatively large friction faces, which cause corresponding large friction losses, thus lowering the efficiency of the implement. In addition, with the magnitude and number of the surfaces which glide against each other, which necessarily require a careful machining and a perfect surface finishing, the manufacturing costs for piston and guide sleeve will correspondingly increase.

SUMMARY OF THE INVENTION

It is an object of the present invention to provide an implement of the above-described type which avoids the disadvantages of such implements known in the art.

More specifically, it is an object of the present invention to provide an impliment of the aforementioned kind which can be manufactured at lesser cost and which has a higher efficiency than such impliments known in the art, while providing a perfect guiding of the piston, so as to assure a long operating life of the impliment.

With these and other objects in view, which will become apparent as the description proceeds, the swing system of the implement mainly comprises a first piston, reciprocatingly guided in a cylinder connected to the housing of the impliment, in which the first piston is pivotally connected to a driven connecting rod and by means of a piston rod rigidly connected with a second piston, also reciprocatingly guided in the cylinder and axially spaced from the first piston. The swing system further comprises a guide sleeve penetrating through the second piston, being axially guided on the piston rod, and carrying at its free end, projecting beyond the cylinder, the tool of the implement and between the pistons an abutment, first spring means abutting with opposite ends respectively against the abutment and the corresponding end face of the second piston, and second spring means respectively abutting with opposite ends against the tool and the other end face of the second piston.

By the division of the guide faces on a first and a second piston, which are axially spaced from each other, it is possible to hold the slide faces of the pistons in the cylinder, at exact axial arrangement of the pistons in the cylinder, very small. The guidance of the guide sleeve, which is connected with the tool, on the piston rod can be made with relatively large tolerances, since an inexact guiding of the guide sleeve on the piston rod has no influence on the exact guiding of the tandem piston in the cylinder. By the reduction of the size of the friction faces between piston and cylinder and by the omission of the friction faces between guide sleeve and cylinder, the friction losses can be considerably reduced and the efficiency of the impliment correspondingly increased, as compared with the implement according to the prior art. With the reduction of the magnitude and number of the interengaging slide faces, it is also possible to considerably reduce the machining costs of the implement according to the present invention, as compared with the implement of the prior art above described. Also the material costs can be reduced with the construction of the present invention, since the diameter of the guide sleeve, which is guided on the piston rod, may be held considerably smaller.

Furthermore, due to the omission of the known guide sleeve, which in the prior art engages with its outer surface thereof the inner surface of the cylinder, the outer diameter of the highly loaded springs may be increased, which leads to a smaller tension at the inner diameters of the springs and therewith to an improvement of the useful life of the same.

In a preferred construction according to the present invention, the second piston is constructed as an annular member surrounding the sleeve, which annular member is rigidly connected with the piston rod by means of a pin. The sleeve is provided with opposite, in axially direction extending slots for the passage of the pin therethrough, and these slots have an axial length to permit sufficient relative movement between the guide sleeve and the piston rod.

This construction will not only assure an economical manufacture of the tandem piston, but in addition it will prevent turning of the tool during its up-and-down movement, so that a bellows arranged between the piston and the tool, preventing in the usual manner penetrating of dirt or dust into the swing system, does not have to absorb torsion forces and may be constructed relatively light, while having a long useful life.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE partially illustrates in axial cross-section the implement according to the present invention.

DESCRIPTION OF THE PREFERRED EMBODIMENT

The implement, partially illustrated in the drawing, may for instance be a tamper for compacting material such as sand, earth or the like. The implement includes a housing 1, only partially illustrated in the drawing, which is provided in its interior with a working cylinder 2. A first piston 3 is axially guided for reciprocating movement in the cylinder 2 and the piston 3 is rigidly connected with a downwardly projecting piston rod 4. In the illustrated construction, the piston 3 and the piston rod 4 are formed out of one piece. A second piston 5, constructed as an annular member, is likewise guided in the cylinder 2 and connected in a rotation preventing manner to the lower end of the piston rod 4 by a pin 6, passing through a transverse bore in the second piston 5. A guide sleeve 7 is arranged axially movable on the piston rod 4, and the guide sleeve 7 projects through the second piston 5 beyond the latter. The guide sleeve 7 is provided with two axially extending opposite slots 8 and 9, through which the pin 6 passes. The inner diameter of the annular piston 5 is dimensioned slightly greater than the outer diameter of the guide sleeve 7 so that the latter may project, as mentioned before, in axial direction through the annular second piston 5. The length of the axial slots 8 and 9 is chosen in such a manner to permit sufficient relative movement in axial direction between the guide sleeve 7 and the piston rod 4 during a maximum stroke of the guide sleeve.

A tool 10, presented in the present example as a stamping plate, is fixedly connected to the free end of the guide sleeve 7, which projects beyond the lower end of the cylinder 2. An abutment, in form of an annular flange 11, is fixedly connected, for instance by welding, to the other end of the guide sleeve 7, which is located between the two pistons. Two coaxial coil springs 12 and 13, arranged about the guide sleeve 7, respectively abut with opposite ends against the abutment 11 and the corresponding face of the second piston 5, and two additional coil springs 14 and 15, arranged about the sleeve portion projecting beyond the second piston 5, respectively abut with opposite ends thereof against the second piston 5 and a corresponding face of the tool 10.

The piston 3 is provided at its upper end with an axial cutout 17, in which one end of an only partially illustrated piston rod 18 extends, which is pivotally connected to the piston 3 by means of a pin 19. The piston rod is driven, in a known manner, from a non-illustrated electromotor or combustion motor over a crank drive and eventually intermediate gearing. The motor, the crank drive and the gearing are mounted in the housing 1 of the implement. During rotation of the motor, the swing system comprising the first piston 3, the piston rod 4, the second piston 5, the guide sleeve 7 and the springs 12–16 and the tool 10 connected to the swing system are continuously reciprocated. A bellows 20 is provided between the housing 1 and the tool 10 to protect the swing system against dust and dirt.

It will be understood that each of the elements described above, or two or more together, may also find a useful application in other types of manually guided implements with tools performing a reciprocating up-and-down motion differing from the types described above.

While the invention has been illustrated and described as embodied in a manually guided implement with a tool performing a reciprocating up-and-down motion and which is driven by a motor over a connecting rod and a swing system guided in a cylinder connected to the housing of the implement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letter Patent is set forth in the appended claims:

1. A manually guided implement with a tool performing a reciprocating up-and-down motion, comprising a cylinder; a first piston axially movably guided in said cylinder; a second piston axially spaced from said first piston and also axially movably guided in said cylinder; a piston rod rigidly connecting said first and said second piston with each other; a guide sleeve axially movable on said piston rod, projecting through said second piston beyond said cylinder and carrying on the free end thereof outside said cylinder the tool; an abutment on the other end of said guide sleeve; first spring means abutting with opposite ends against said abutment and said second piston; second spring means abutting with opposite ends against said second piston and said tool, said spring means forming with said guide sleeve, said first and said second piston and said piston rod a swing system; and drive means connected to said swing system for reciprocating the same in said cylinder.

2. An implement as defined in claim 1, wherein said second piston is an annular member surrounding said piston rod, and including a pin rigidly connecting said annular member to said piston rod, said guide sleeve being provided with a pair of opposite axially extending slots through which said pin extends, said slots having an axial length to permit sufficient relative movement between said guide sleeve and said piston rod.

3. An implement as defined in claim 2, wherein said first piston and said piston rods are integral with each other, and wherein said annular member constituting said second piston is connected to the free end of said piston rod.

4. An implement as defined in claim 1, wherein said abutment on the other end of said guide sleeve is an annular flange.

5. An implement as defined in claim 1, wherein said spring means are coil springs coaxial with said guide sleeve.

6. An implement as defined in claim 1, wherein each of said first and second spring means comprises a pair of coil springs of different diameters coaxial with said guide sleeve.

7. An implement as defined in claim 1, wherein said drive means comprise a connecting rod pivotally connected to said first piston.

8. An implement as defined in claim 1, and including an axially extending bellows between said cylinder and said tool and surrounding a portion of said guide sleeve and that of said second spring means which project beyond said cylinder.

9. An implement as defined in claim 1, wherein said tool is a tamping tool.

* * * * *